United States Patent [19]

Prater

[11] 4,398,456

[45] Aug. 16, 1983

[54] MACHINE FOR CONVERTING RETURNABLE CANS INTO METAL INGOTS

[76] Inventor: Larry P. Prater, 9802 William, Taylor, Mich. 48180

[21] Appl. No.: 292,318

[22] Filed: Aug. 12, 1981

[51] Int. Cl.[3] ..... B30B 9/32

[52] U.S. Cl. ..... 100/98 R; 29/403.2; 100/218; 100/244; 100/251; 100/257; 100/272; 100/289; 100/295; 100/902

[58] Field of Search ..... 100/902, 272, 98 A, 100/289, 218, 257, 244, 295, 39, 264, 251, 85, 229 A, 98 R; 29/403.1, 403.2; 52/DIG. 9

[56] References Cited

U.S. PATENT DOCUMENTS

| | | | |
|---|---|---|---|
| 184,931 | 11/1876 | Unbehend | 100/264 |
| 607,063 | 7/1898 | Mallett | 100/244 X |
| 1,965,177 | 7/1934 | Finkl | 100/295 X |
| 3,907,087 | 9/1974 | Tanaka | 100/902 X |
| 3,926,033 | 12/1975 | Forichon | 100/272 X |
| 3,942,430 | 3/1976 | Day | 100/295 X |
| 3,993,221 | 11/1976 | Boynton et al. | 100/98 R X |
| 4,326,457 | 4/1982 | Sather | 100/902 X |

FOREIGN PATENT DOCUMENTS

| | | | |
|---|---|---|---|
| 2427760 | 1/1976 | Fed. Rep. of Germany | 100/98 R |
| 402971 | 12/1933 | United Kingdom | 100/257 |

*Primary Examiner*—Billy J. Wilhite

*Attorney, Agent, or Firm*—Stephenson and Boller

[57] ABSTRACT

A machine for reducing, crushing, and joining used metal cans to form an ingot comprising a stack of laminated crushed cans. The reducing chamber contains a vertically adjustable platen on which the ingot is formed. The cans are reduced, crushed, and joined by a ram which is operated within the chamber. Punches on the ram are effective to pierce extruded holes in the crushed cans after the cans have been flattened. The ram is powered hydraulically, or by any other pressure producing device, via a toggle so that an increasing compression force is developed as the cans are crushed.

10 Claims, 10 Drawing Figures

MACHINE FOR CONVERTING RETURNABLE CANS INTO METAL INGOTS

BACKGROUND AND SUMMARY OF THE INVENTION

The present invention pertains generally to crushing machines and is particularly directed to a machine for crushing metal cans so as to convert the cans into a metal ingot comprising a lamination of crushed cans.

Metal cans enjoy widespread use as beverage containers. While such cans come in various sizes and different materials, probably the most widespread can in use today is the 12-ounce aluminum beverage can. Rather than being discarded as trash, used aluminum cans may be recycled, thereby conserving aluminum. Therefore, collecting stations have been established at which used aluminum cans are collected for recycling. The used cans are usually collected in large plastic bags or cardboard containers.

Entirely a part from the matter of voluntary recycling, local laws or regulations may impose a deposit on a metal beverage container at the time that the canned beverage is sold to the customer. The container may be of any size and material. Such laws and/or regulations may promote the purposes of encouraging recycling so as to conserve on raw materials and/or the purpose of reducing litter caused by the indiscriminate discarding of used containers, which occurs where a deposit is not required. Statistics bear out the fact that where deposits are required, litter is reduced. This means that not only is the environmental quality improved, but it also means that costs associated with picking up the discarded litter, which are ultimately borne by the taxpayer, are significantly reduced. In localities having deposit containers, the typical practice is for the used containers to be returned to the selling location where the deposits are refunded. Where the selling location does a substantial amount of business, the returned cans must be collected and this has, in the case of the recycling centers, typically involved collection of the cans in large plastic bags and/or cardboard bins.

The collection of used cans according to the foregoing procedures requires very bulky containers in which the cans are collected. A greater efficiency in handling of the returned cans can be achieved if the bulk of the cans is reduced, for example by crushing.

The present invention is directed to a new and improved machine which is particularly useful in conjunction with processing of returnable cans. More specifically the invention functions to crush the metal cans and join them together in such a manner as to form a solid metal ingot comprising a lamination of crushed cans. The metal ingot itself may be delivered to the recycling location.

The invention provides a number of significant advantages. For one it is unnecessary for separate plastic bags or cardboard containers to be used to collect metal cans. Another advantage is that a considerable savings in floor space is achieved because usage of collection bins such as the cardboard containers or plastic bags becomes unnecessary. With the invention, returned cans may be crushed at the time of their return. The newly crushed cans are, during the crushing procedure, joined to a previous accumulation of crushed cans so that the continuing process of crushing cans as they are received results in a creation of the solid metal ingot consisting of the accumulation of crushed cans. The invention is also compact, and therefore will not take up nearly the amount of floor spaces which must today be devoted in a typical supermarket or beverage store for collection of returned cans.

The invention may be also used to advantage in a retail location in conjunction with automatic equipment which serves to identify the returned cans by brand so that accurate tallies of deposit refunds can be provided by the retailer to the wholesaler for reimbursement. A still further feature of the invention is that it executes a highly efficient procedure for reducing the cans into a metal ingot. Specifically the procedure involves first a reduction and compression of the cans into a generally flat condition and thereafter a piercing of the flattened crushed cans so as to join overlying cans together at the points of piercing.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time for carrying out the invention.

DESCRIPTION OF THE PREFERRED EMBODIMENT

Figure 1:
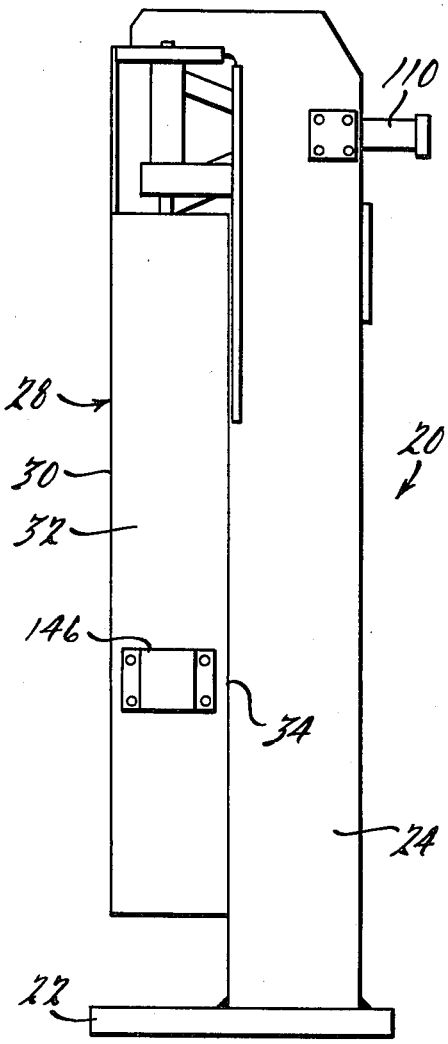
FIG. 1 is a side elevational view of a machine embodying principles of the present invention.
Figure 2:
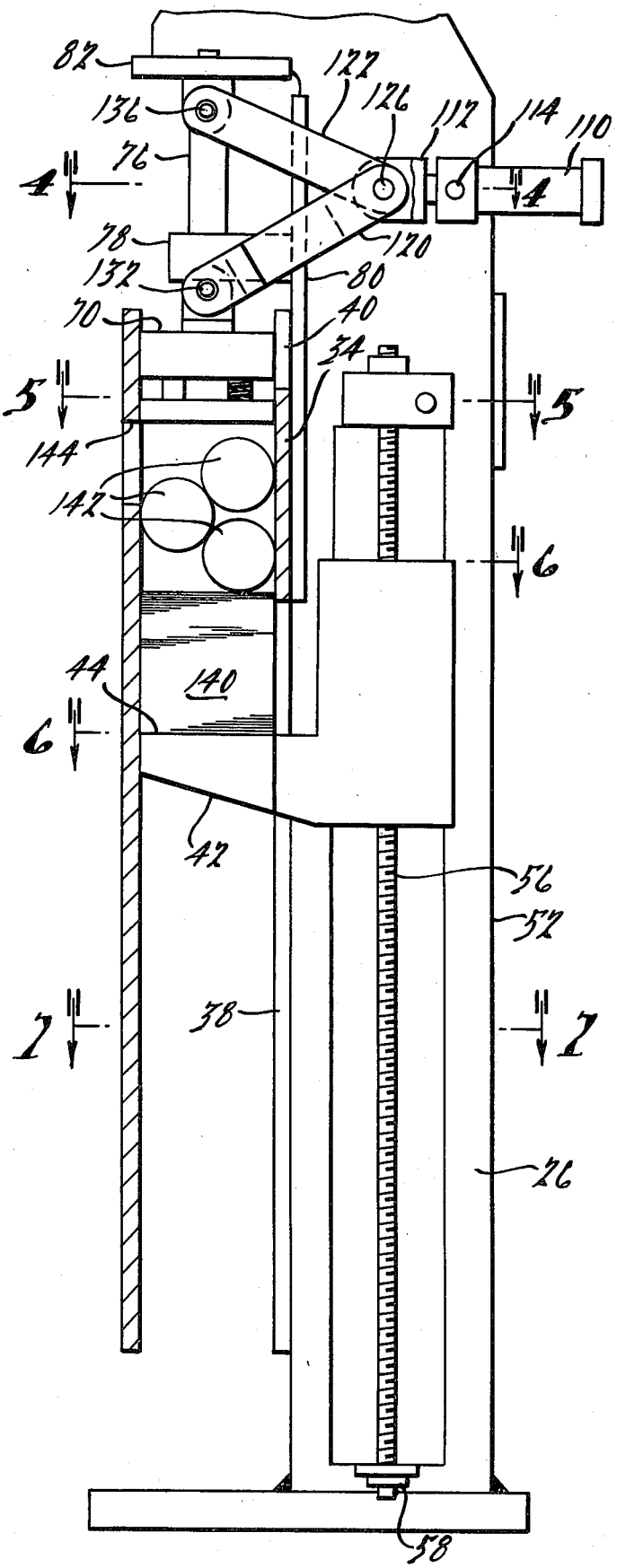
FIG. 2 is a central vertical sectional view looking from the same direction as in FIG. 1 and enlarged.
Figure 3:
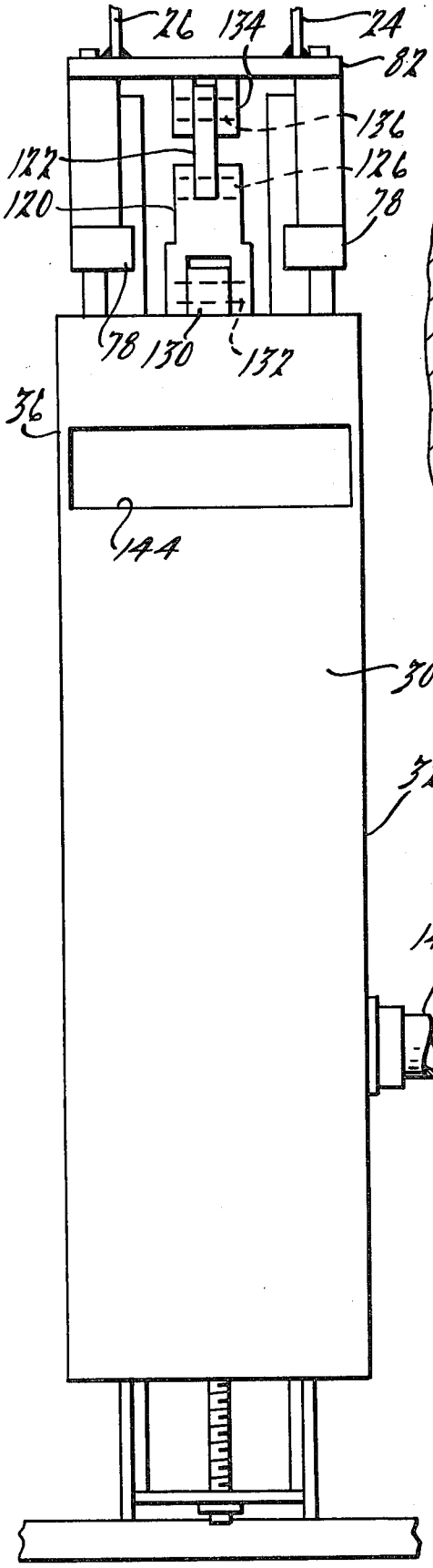
FIG. 3 is a front elevational view of the machine of FIGS. 1 and 2 and on the same scale as the view of FIG. 2.

The drawings illustrate a machine 20 embodying principles of the present invention. As best seen in FIGS. 1, 2, and 3, machine 20 comprises a flat horizontal base plate 22 which supports a pair of laterally spaced vertical upright plates 24 and 26. As viewed in FIGS. 1 and 2 this arrangement defines a generally reverse-C shaped frame for the machine.

Disposed within the throat area of this reverse-C shaped frame between the two uprights 24,26 is a reducing chamber 28. Reducing chamber 28 has a vertical axis and comprises four vertical sidewalls 30, 32, 34, and 36 enclosing the interior of the chamber, but being open at the top and bottom. Sidewall 30 is of a full rectangular shape and is toward the front of the machine. Sidewall 32 is of a full overall rectangular shape and is at the right hand side of the machine as viewed in FIG. 3. Sidewall 34 forms the rear wall of chamber 28 and is of a full overall rectangular shape except for a central vertical slot 38, also of rectangular shape, which is provided centrally of the chamber between the two uprights 24, 26 and which extends from the bottom of sidewall 34 upwardly almost three quarters of the height of that sidewall. A shorter, narrower vertical slot 40 extends centrally downwardly from the top edge of sidewall 34. Sidewall 36 is of rectangular shape but extends downwardly from the top of the chamber only approximately one half of the overall height as referenced to the overall height of each of the other three sidewalls.

As can be seen from the consideration of the cross sectional views of FIGS. 4 through 7 the four sidewalls define a generally rectangularly shaped interior for the reducing chamber. The drawing figures show the sidewalls to be integrally joined with each other; however, in usual practice it will be appreciated that the sidewalls, like the base and uprights, may be individual metal plates, which are joined together by any suitable means such as by welding, brazing, and/or bolting.

Machine 20 further includes a platen 42 having a horizontally disposed support portion 44 disposed within reducing chamber 28. The support portion 44 has a flat horizontal top surface, and as viewed axially of the reducing chamber, a rectangular shape closely conforming to that of the rectangular cross section of the reducing chamber. The platen also includes an intermediate portion of reduced width 46 which extends through slot 38. This intermediate portion joins the portion 44 to a further portion 48. This further portion 48 has a generally vertical extent and includes a pair of parallel guideways 50 on opposite lateral sides. The guideways dovetail with corresponding vertical guides 52 which are mounted on the inwardly facing surfaces of the vertical uprights 24, 26. In this way platen 44 is guided for vertical travel on the frame.

The vertical position of the platen is controlled by a screw and nut type drive mechanism. A nut 54 is affixed to the center of portion 48. Nut 54 is threadedly engaged by a vertical drive screw 56. The drive screw is vertically supported on the frame of the machine and the load is supported for the most part by a suitable bearing 58 on base 22.

A screw actuator mechanism 60 is provided on the machine frame at the top of the drive screw. This mechanism comprises a pinion 62 affixed to the upper end of drive screw 56, a worm 64 and a wheel 66. Worm 64 and wheel 66 are disposed on a common shaft 68 having a horizontal axis. The worm meshes with the pinion and the wheel is at the outside of the upright 24 so as to be available for actuation. With this arrangement rotation of wheel 66 will be effective via worm 64 and pinion 62 to rotate screw 56. Rotation of screw 56 in turn imparts vertical motion to platen 42. In this way the vertical position of the top support surface of portion 44 is established by operation of wheel 66. As will be seen, positioning of the platen support surface is important in obtaining the optimum compacting action on cans.

A ram 70 is disposed for vertical reciprocation in the upper portion of the reducing chamber. Details of ram 70 are perhaps best seen in FIG. 8. The ram comprises a generally rectangularly shaped punch retainer plate 72. A pair of guide rods 74 project vertically upwardly from opposite sides of punch retainer 72, and have close sliding fits within cylindrical guide tubes 76 which are supported on the machine frame. Each guide tube 76 is supported on a member 78 which projects horizontally forwardly from a vertical back plate 80. The back plates 80 are suitably mounted on the machine frame; for example, each may be secured to the corresponding upright 24, 26. The upper end of each guide tube 76 may also be attached to a horizontal top plate 82 which is affixed to the underside of the overhanging protions of the uprights.

A stripping plate 84 is supported on the underside of punch retainer 72. Stripping plate 84 has a rectangular shape substantially identical, when viewed axially of the reducing chamber, to the rectangular shape of punch retainer 72. Mounting of the stripping plate on the retainer plate is accomplished by means of bolts 86 at the four corners of the two plates 72, 84. Each bolt 86 passes through a corresponding counterbored hole 88 in the retainer plate and is threaded into a tapped hole 90 in the stripping plate. In this way when the heads of the bolts abut the shoulders 92 of the counterbored holes 88, there is a maximum separation between the two plates. The arrangement, however, allows the stripping plate to be displaced upwardly toward the retainer plate.

A set of five piercing punches 94 is mounted on punch retainer plate 72. Each individual punch 94 has a circular cylindrical main body the upper portion of which fits closely in a corresponding hole 96 in the underside of the punch retainer. The punch is secured by means of a screw 98, which passes through a corresponding hole in the top of the retainer plate and threads into a tapped hole in the upper end of the punch. The punches project downwardly from the retainer plate, and each terminates in a downwardly projecting punch tip 100. Stripping plate 84 includes a suitable circular clearance hole 102 for each punch 94.

Figure 8:
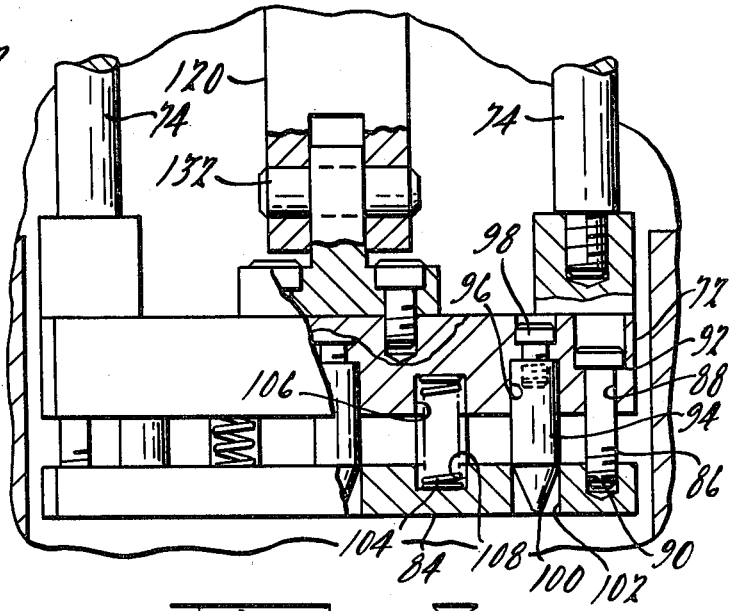
FIG. 8 is a vertical fragmentary view partly in section through a portion of the machine.
Figure 9:
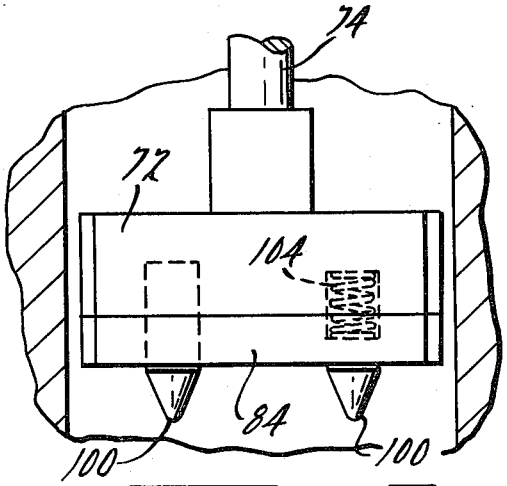
FIG. 9 is a fragmentary side elevational view of the view of FIG. 8, but showing a different operative position.

FIG. 8 illustrates the condition of the ram with the stripping plate at maximum separation from the retainer plate. In this position it will be noted that the tips 100 of the punches do not project through the stripping plate, rather the tip of each punch is substantially flush with the lower surface of the stripping plate. A set of five compression springs 104 is also provided between the retainer plate and the stripping plate. The upper end of each spring 104 is disposed in a corresponding hole 106 in the underside of retainer plate 72 while the lower end of each spring fits within a hole 108 in the top side of stripping plate 84. The springs exert a force which resists the displacement of the stripping plate toward the retainer plate. The arrangement is such that a predetermined force must be applied before the stripping plate is displaced bodily upwardly relative to the retainer plate. Once the stripping plate begins to be displaced bodily upwardly relative to the retainer plate, the tips 100 of the punches begin to project from the lower surface of the stripping plate. When there is maximum compression of the springs and the stripping plate is flush against the retaining plate, there is maximum projection of the punch tips from the lower surface of the stripping plate.

Figure 5:
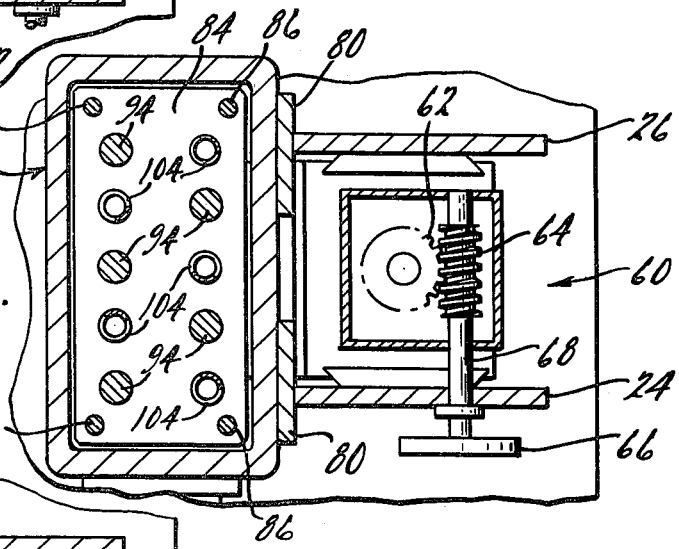
FIG. 5 is a horizontal sectional view taken in the direction of arrows 5—5 in FIG. 2.
Figure 6:
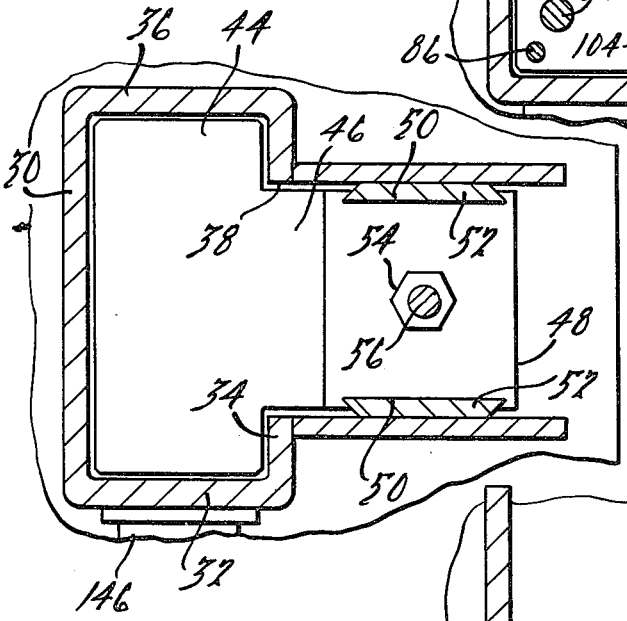
FIG. 6 is a horizontal sectional view taken in the direction of arrows 6—6 in FIG. 2.
Figure 7:
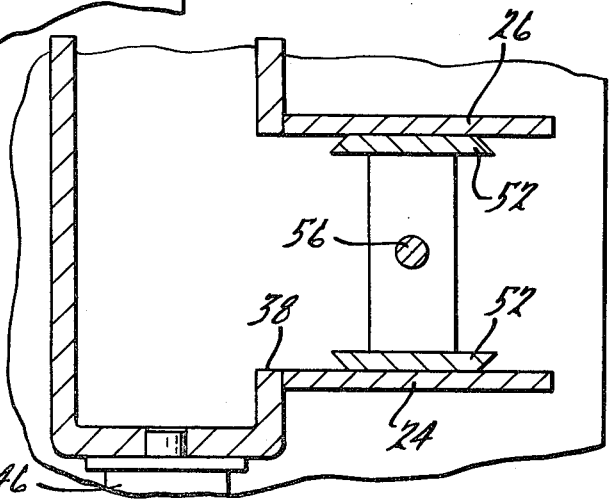
FIG. 7 is a horizontal sectional view taken in the direction of arrows 7—7 in FIG. 2.

The arrangement of the punches and springs is best seen in FIG. 5 and consists of two rows of five each, wherein each row has alternating springs and pins, and where the pins and springs of one row are staggered in relation to the pins and springs of the other row.

Figure 4:
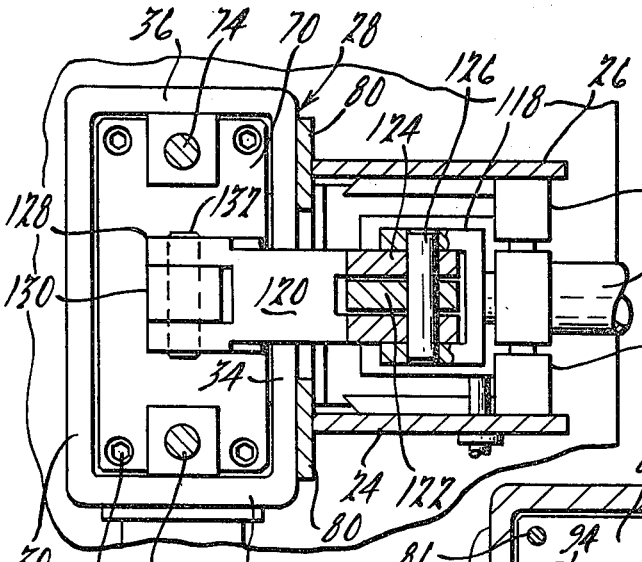
FIG. 4 is a horizontal sectional view taken in the direction of arrows 4—4 in FIG. 2.

The mechanism for operating ram 70 comprises a power cylinder 110 and a toggle linkage 112. The power cylinder 110 is disposed centrally between the two uprights 24, 26 and the axis of the cylinder is disposed in a generally horizontal orientation. Cylinder is, however, mounted for pivotal movement about a horizontal transverse axis 114 near the rod end of the cylinder. Pivotal mounting is accomplished by suitable pivots 116 on either side of the cylinder between the uprights 24, 26. As best seen in FIG. 4, the end of the cylinder rod includes a clevis 118. The clevis provides connection of the power cylinder to toggle 112. The toggle comprises two links 120, 122. Link 120 includes a clevis 124 which is disposed within clevis 118. The lower end of link 122 fits within clevis 124. Suitable aligned holes are provided in clevises 118, 124, and the lower end of link 122 and a pivot pin connection 126 passes through these holes thereby joining the two links to the cylinder rod.

The lower end of link 120 includes a clevis 128 fitting onto a bracket 130 which is affixed to the top of punch retainer plate 72. A pivot pin 132 passes through aligned holes in clevis 128 and bracket 130 to provide a pivotal connection of the lower end of link 120 to ram 70.

A clevis bracket 134 mounts on the underside of plate 82, and the upper end of link 122 fits within this clevis. A pivot pin 136 passes through aligned holes in clevis 134 and link 122 thereby providing a pivot connection.

FIG. 2 illustrates the cylinder 110 in the retracted position. In this position ram 70 is at its uppermost vertical position. When the cylinder is actuated to extend the cylinder rod, the arrangement is such that ram 70 is displaced vertically downwardly within the reducing chamber, cylinder 110 pivoting about axis 114 as the cylinder rod is extended. Slot 40 provides clearance for the lower link 120 during operation of the toggle.

FIG. 2 illustrates a possible operating condition of the machine in crushing cans so as to form a solid metal ingot of crushed cans which are integrally joined together. Specifically FIG. 2 illustrates an accumulation of crushed, flattened, and joined cans forming an ingot 140 and a set of three as yet uncrushed cans, each of which is identified by the reference numeral 142. The ingot of crushed cans 140 is supported on platen 42 in the reducing chamber. The as yet uncrushed cans have been loaded into the machine at an entrance aperture 144 provided in sidewall 28. The horizontal dimensions of the crushing chamber are such that the uncrushed cans will assume a position which is typified by that shown in FIG. 2. In other words, the horizontal dimension which appears in FIG. 2 is greater than the width of one can but less than the width of two cans. The horizontal dimension in the other direction is such to accommodate the different sizes of cans, for example, the chamber may be designed to accommodate a taller, 16-ounce can which would inherently accommodate the shorter 12-ounce can. The punch configuration is such that all cans will be joined to the ingot.

The illustrated construction for the toggle is such that its three pivot points are located essentially at the apices of an equilateral triangle when the ram is in its uppermost position. The cylinder 110 has a sufficient extension length so that the two links of the toggle may be operated to an almost vertical aligned position. This defines the available stroke for ram 70.

It has been found that the illustrated cylinder and toggle arrangement when taken in conjunction with the construction of the ram provides an excellent arrangement for reducing, crushing, and piercing the cans to form the solid ingot 140. It is, therefore, desirable for the platen to be adjusted to a suitable position so that optimum operation can be accomplished. The particular platen position should be such that the top of the accumulated stack of crushed cans forming the ingot 140 is at a level which, when a new set of uncrushed cans is loaded into the machine, will allow the ram to be displaced downwardly almost the full extent of its stroke so that the toggle links 120, 122 are almost vertical. The illustrated arrangement exerts a downward force on ram 70 such that as the ram 70 moves downwardly an increasing compression force is exerted on the cans being crushed with the compression force increasing as the cans are reduced from their uncrushed state to their crushed state. The arrangement provides an improved efficiency because the linkage provides a low compression force while the volumes of the cans are large and yet provides a high pressure force when the volumes of the cans are low.

Figure 10:
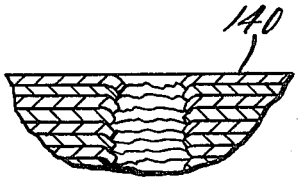
FIG. 10 is a fragmentary sectional view illustrating a consequence of the operation of the machine in forming a metal ingot from crushed cans.

The initial crushing force applied to the cans is less than the force which is exerted by springs 104 between the retainer and stripping plates. This means that as the cans are initially crushed toward a compressed state punches 94 remain retracted. The characteristics of the springs 104 are such that it is only after the cans have been reduced to a very flattened state that the punches are effective. In the illustrated example this occurs toward the end of the full downward stroke of the ram. For example, the punches begin to be effective only over perhaps say the last fifteen percent of the ram stroke. As the punches begin to protrude through the stripping plate, the punch tips pierce the crushed cans. The overlying stripping plate confines the metal flow so that the punches in effect pierce a downwardly extruded hole through the overlying cans. The downwardly extruded material from a can interlocks with the corresponding holes which have been pierced in the previously crushed cans. The typical condition is illustrated approximately in FIG. 10. In this way the newly crushed cans are compressed and integrally joined to the existing accumulation of crushed cans thereby forming the solid metal ingot of crushed cans. Suitable clearance holes may be provided in the platen, if needed, for the punches so that the bottom cans of the ingot can be joined together.

Once a load of cans has been crushed, the cylinder is actuated to retract the cylinder rod and elevate the ram. As the ram is elevated springs 104 are effective via stripping plate 84 to disengage the punches from the stack of metal cans so that the newly crushed cans are not dislodged from the stack because of any tendency to stick on the punches. Once the ram has been fully elevated a new set of cans may be loaded via the opening 144.

When desired, the ingot consisting of the accumulated load of cans may be emptied from the machine by running platen 42 down to a level where the top of the stack of accumulated cans clears the lower edge of side wall 36. Because the solid metal stack of cans may have an appreciable weight, unloading is facilitated by means of an ejection cylinder 146 mounted on sidewall 32 of the reducing chamber. The eject cylinder may be actuated so that the cylinder rod is extended to push the stack of crushed cans out of the machine and onto a suitable conveyance for carrying them away.

Preferably, the cylinders 110, 146 are hydraulic cylinders. Hence, suitable hydraulic equipment will be provided in order to actuate these cylinders. This equipment is entirely conventional and is therefore not shown in the drawing. For example, this hydraulic equipment would typically include a hydraulic pump driven by an electric motor. A control valve is associated with each cylinder and is a conventional three way directional valve. When the motor is operated, the pump supplies pressurized hydraulic fluid from a reservoir to the control valves. Each control valve may be actuated to correspondingly extend or retract the corresponding cylinder as desired. The illustrated arrangement for moving the platen may involve simply a manual operation of wheel 66; alternatively there could be a motorized or power arrangement for vertically elevating and lowering the platen.

It will be observed that the entire process for forming the metal ingot of crushed cans has taken place in a machine occupying a relatively small amount of floor space. There are no massive accumulations of uncrushed cans which require plastic storage bags or cardboard storage cartons, and which occupy a large amount of floor space. The illustrated machine may be used to crush various types of cans made of different can materials and/or different sizes. However, for recycling purposes it will be most desirable to restrict usage of the machine to a particular can material, for example, aluminum. This will avoid mixing of different can materials, which could pose a problem in successful recycling. Thus, while a preferred embodiment and usage of the invention have been disclosed, it will be appreciated that principles of the invention are applicable to other embodiments and to other types of usage.

What is claimed is:

1. A machine for creating a solid mass of crushed cans from individual used metal cans comprising a chamber, first means within the chamber on which the mass of crushed cans is supported, second means operable within the chamber to crush the cans to flattened conditions and pierce the flattened cans so that the flattened cans join together at the points of piercing thereby forming the solid mass of crushed cans, the first means comprising a platen movably mounted on the machine for movement relative to the chamber and which is increasingly moved within the chamber away from the second means as more cans are crushed and joined to the solid mass of crushed cans so that the location within the chamber at which cans are crushed and joined to the solid mass of crushed cans remains substantially the same irrespective of the size of the solid mass of crushed cans, and wherein the platen has a support portion within the chamber on which the mass of cans is supported and a further portion exterior of the chamber, and drive means engaging said further portion for adjusting the position of the support portion within the chamber.

2. A machine as claimed in claim 1, wherein the second means comprises a ram reciprocally mounted in the chamber and power means for operating the ram.

3. A machine as claimed in claim 2 wherein said power means comprises a hydraulic cylinder and a toggle mechanism.

4. A machine as claimed in claim 2 wherein said ram comprises a punch retainer comprising a plurality of piercing punches and a stripper plate mounted on the punch retainer.

5. A machine as claimed in claim 4 wherein the punches are arranged in a staggered pattern on the punch retainer.

6. A machine as claimed in claim 2 wherein the depth of the chamber is greater than the length of the cans and the width of the chamber is between one and two can diameters.

7. A machine as claimed in claim 6 wherein the entrance into the chamber for the cans is in a wall of the chamber which runs lengthwise.

8. A machine as claimed in claim 7 wherein the exit from the chamber for the mass of cans is in a wall perpendicular to the entrance and including a pusher for pushing the mass of cans out the exit.

9. A machine as claimed in claim 1 wherein the machine includes a frame having a pair of spaced uprights and including guide and guideway means for guiding the platen on the uprights, said drive means being disposed between the uprights.

10. A machine as claimed in claim 1 wherein said drive means comprises a screw threadedly engaging said further portion for adjusting the position of said support portion within the chamber, said screw having its axis parallel to the direction of adjustment of said support portion within the chamber.

* * * * *